United States Patent [19]

Schirmer et al.

[11] Patent Number: 4,475,883

[45] Date of Patent: Oct. 9, 1984

[54] PRESSURE CONTROL FOR STEAM GENERATOR

[75] Inventors: Robert M. Schirmer; William E. Thornberry, both of Bartlesville, Okla.

[73] Assignee: Phillips Petroleum Company, Bartlesville, Okla.

[21] Appl. No.: 354,565

[22] Filed: Mar. 4, 1982

[51] Int. Cl.[3] ..... F23R 1/06

[52] U.S. Cl. ..... 431/158; 431/190; 92/257; 166/59; 166/320; 251/63.5; 239/456

[58] Field of Search ..... 431/157, 158, 353, 190; 166/59, 320, 321; 60/39.55; 251/62, 63, 63.5; 92/257, 255; 239/456, 541, 579

[56] References Cited

U.S. PATENT DOCUMENTS

| | | | |
|---|---|---|---|
| 235,971 | 12/1880 | Stevens | 92/257 |
| 2,640,543 | 6/1953 | Childers | 251/63 |
| 2,665,712 | 1/1954 | Pratt | 251/63.5 |
| 2,728,547 | 12/1955 | Crookston et al. | 251/63 |
| 3,757,816 | 9/1973 | Price | 166/320 |
| 4,009,756 | 3/1977 | Zehren | 166/321 |
| 4,159,743 | 7/1979 | Rose et al. | 166/302 |

*Primary Examiner*—Lee E. Barrett

[57] ABSTRACT

A steam generator including a combustion chamber having fuel and air inlets at the upstream end and a water inlet at the downstream end to inject water into the flue gas, a vaporizer in communication with the downstream end of the combustor and a pressure control to vary the size of the discharge opening of the vaporizer and thus control the pressure within the combustor and vaporizer, including; a slideably movable plug attached to and operable by a fluid operated piston.

12 Claims, 4 Drawing Figures

PRESSURE CONTROL FOR STEAM GENERATOR

The present invention relates to the method and apparatus for the control of pressure in a tubular chamber. More specifically, the present invention relates to a method and apparatus for the control of pressure in a steam generator for the recovery of hydrocarbons.

BACKGROUND OF THE INVENTION

With the rapidly declining availability of hydrocarbon fuels, particularly from petroleum sources, there is a great need to extend efforts for the recovery of the petroleum to sources heretofore practically or economically unattractive and to the recovery of hydrocarbon fuels from alternate sources. A major potential source of petroleum, which has heretofore been virtually untapped because of the inability of most refineries to handle such crudes and the inability and expense of recovering them, are heavy oil deposits. Two basic methods have heretofore been applied in the recovery of such heavy oil deposits, namely; in situ combustion and steam injection methods. Both of these techniques have been limited by the fact that both require the burning of substantial amounts of the oil itself, or equivalent fuels, in order to reduce their viscosity and permit production thereof. This is true even with increased prices of oil. For example, to evaluate the economics of steam injection, the oil/steam ratio (OSR) is utilized. The OSR is the ratio of additional oil recovered for each ton of steam injected. Since it is necessary to burn about eight tons of fuel to get one hundred tons of steam, an OSR of 0.08 has a thermal balance of 0; i.e., you burn as much oil to generate the steam as you produce. Generally, wells in the Kern River Field of California operate with an OSR of 0.24, and are abandoned when they get below 0.15.

However, with the decontrol of heavy oil prices several years ago, substantial work has been done and commercial operations are presently under way utilizing steam recovery techniques for the recovery of heavy oil. In addition, the technology has progressed to the point where application of steam technology to other resource areas such as tar sands, diatomaceous earth, oil shale, and even residual light oil are technically feasible. However, until fairly recently, the state of the art techniques for heavy oil production by steam injection have produced only about 40% to 55% of the oil in place. This of course, is close to the ragged edge of being economic and leaves substantial volumes of oil unrecovered.

Most commercial operations, at the present time, are confined to the use of conventional steam boilers for the generation of steam. Usually, the lease crude is used as a fuel. However, when one considers that 80% to 85% of the cost of a steam injection operation is cost of the fuel, this obviously is a major factor. As a result, a number of alternate energy sources, some rather exotic, have been suggested, including petroleum coke, low BTU lignite coal, natural gas, almond hulls and tree prunings, solar energy, etc. However, except for solar energy, all suggested and used sources of energy for steam generation have the same problems and disadvantages.

First of all, conventional steam boilers waste about 19% of the fuel value in stack losses, about 3% to 20%, commonly 13%, in flow lines from the boiler to the wellhead and about 3% in the well bore at depths up to about 2900 feet and about 20% at depths below 2900 feet. As a matter of fact, at depths below 2900 feet, the steam has generally degraded to hot water. Considerable work has been done and some progress made in the elimination of well bore losses by the use of insulated tubing for the injection of steam. However, it is generally accepted that the practical limit for conventional steam injection is about 2,000 to 2,500 feet. This limit, of course, eliminates substantial volumes of heavy oil below this depth. For example, the National Petroleum Council has recently estimated that there are from about 1.6 to 2.1 billion barrels of heavy oil in California, Texas and Louisiana alone, which are not recoverable by conventional steaming methods.

In addition, numerous heavy oil reservoirs will not respond to conventional steam injection since many have little or no natural drive pressure of their own and, even when reservoir pressure is initially sufficient for production, the pressure obviously declines as production progresses. Consequently, conventional steaming techniques are of little value in these cases, since the steam produced is at a low pressure, for example, several atmospheres. Consequently, continuous injection of steam or a "steam drive" is generally out of the question. As a result, a cyclic technique, commonly known as "huff and puff" has been adopted in many steam injection operations. In this technique, steam is injected for a predetermined period of time, steam injection is discontinued and the well is shut in for a predetermined period of time, referred to as a "soak". Thereafter, the well is pumped to a predetermined depletion point and the cycle repeated. This technique has the disadvantages that it depends, for the recovery of oil, solely on a decrease in viscosity of the oil and the steam penetrates only a very small portion of the formation surrounding the well bore, particularly since the steam is at a relatively low pressure.

There are also known to be large amounts of untapped heavy oil in offshore locations. To date there have been no efforts to even test steaming in these reservoirs. Conventional boilers are obviously too large for offshore production platforms, even though it has recently been proposed to cantilever such a steam generator off the side of a production platform. However, in addition, such conventional steaming methods raise complex heat loss problems. Further, conventional boilers cannot use sea water as a source of steam because of the obvious fouling and rapid destruction of the boiler tubes.

One of the most formidable problems with conventional steam generation techniques is the production of air pollutants, namely, $SO_2$, $NO_x$ and particulate emissions. By way of example, it has been estimated that when burning crude oil having a sulfur content of about 2%, without flue gas desulfurization and utilizing 0.3 barrels of oil as fuel per barrel of oil produced, air emissions in a San Joaquin Valley, Calif. operation would amount to about 40 pounds of hydrocarbons, 4,000 pounds of $SO_2$, 800 pounds of $NO_x$ and 180 pounds of particulates per 1,000 barrels of oil produced. When these figures are multiplied in a large operation and a number of such operations exist in a single field, the problems can readily be appreciated. Consequently, under the Clean Air Act, the Environmental Protection Agency has set maximum emissions for such steaming operations, which are generally applied area wide, and states, such as California where large heavy oil fields exist and steaming operations are conducted on a commercial scale, have even more stringent limitations. Consequently, the number of steaming operations in a given field have been severely limited and in some cases it has been necessary to completely shut down an operation. The alternative is to equip the generators with expensive stack gas scrubbers for the removal of $SO_2$ and particulates and to adopt sophisticated $NO_x$ control techniques. This, of course, is a sufficiently large cost to make many operations uneconomic. Further, such scrubbers also result in the production of toxic chemicals which must be disposed of in toxic chemical dumps or in disposal wells where there is no chance that they will pollute ground waters.

Another solution to the previously mentioned well bore losses has been proposed in which a low pressure burner is lowered down the well to generate steam adjacent the formation into which the steam is to be injected. The flue gas or combustion products are then returned to the surface. This, of course, has the definite disadvantages that the flue gas or combustion products must be cleaned up at the surface in the same manner, probably at the same cost, as surface generation systems. Further, the low volumetric rate of heat release attainable in such a burner severely limits the rate of steaming or requires a much larger diameter well.

It has also been proposed to utilize high pressure combustion systems at the surface of the earth. Such a system differs from the low pressure technique to the extent that the water is vaporized by the flue gases from the combustor and both the flue gaas and the steam are injected down the well bore. This has been found to essentially eliminate, or at least reduce or delay, the necessity of stack gas clean up and the use of $NO_x$ reduction techniques. The mixture conventionally has a composition of about 60% to 70% steam, 25% to 35% nitrogen, about 4% to 5% carbon dioxide, about 1% to 3% oxygen, depending upon the excess of oxygen employed for complete combustion, and traces of $SO_2$ and $NO_x$. The $SO_2$ and $NO_x$, of course, create acidic materials. However, potential corrosion effects of these materials can be substantially reduced or even eliminated by proper treatment of the water used to produce the steam. There is a recognized bonus to such an operation, where a combination of steam, nitrogen and carbon dioxide are utilized, as opposed to steam alone. In addition to heating the reservoir and oil in place by condensation of the steam, the carbon dioxide dissolves in the oil, particularly in areas of the reservoir ahead of the steam where the oil is cold and the nitrogen pressurizes or repressurizes the reservoir. In fact, in certain types of reservoirs it is believed that the nitrogen creates artificial gas caps which aid in production. As a result of field tests, it has been shown that the high pressure technique results in at least a 100% increase in oil production over the use of steam alone and shortening the time of recovery to about two-thirds of that for steam injection alone. Such tests have generally been confined to injection of steam utilizing the "huff and puff" technique, primarily because results are forthcoming in a shorter period of time and comparisons can be readily made. However, utilization of the high pressure technique in steam drive operations should result in even further improvements. A very serious problem, however, with the currently proposed above ground high pressure system is that it involves a large hot gas generator operating at high pressures and high temperatures. This creates serious safety hazards and, when operated by unskilled oil field personnel, can have the potential of a bomb. One solution to the problems of the heat losses, during surface generation and transmittal of the steam-flue gas mixture down the well, and air pollution, by generating equipment located at the surface, is to lower a combustor-steam generator down the well bore to a point adjacent the formation to be steamed and inject a mixture of steam and flue gas into the formation. This also has the above-mentioned advantages of lowering the depth at which steaming can be economically and practically feasible and improving the rate and quantity of production by the injection of the steam-flue gas mixture. Such a technique was originally proposed by R. V. Smith in U.S. Pat. No. 3,456,721. If such an operation is also carried out in a manner to achieve high pressure, the reservoir can also be pressurized or repressurized. Extensive work has been conducted on this last technique for the U.S. Department of Energy's Division of Fossil Fuel Extraction. While most of the problems associated with such a system have been recognized, by these and other prior art workers, to date practical solutions to these problems have not been forthcoming. In order to be effective, for steam injection, the power output of the combustor should be at least equivalent to the output of current surface generating equipment, generally above about 7MM Btu/hr. In order to be useful in a sufficiently large number of reservoirs, the output pressure must be above about 300 psi. The combustor must also be precisely controlled so as to maintain flame stability and prevent flame out, etc. Such control must also be exercised in feeding and maintaining proper flow of fuel and combustion supporting gas and combustion stoichiometry for efficient and complete combustion, thereby eliminating incomplete combustion with the attendant production of soot and other particulate materials, since excessive amounts of combustion suporting gas for stoichiometric combustion could contribute to corrosion and excessive amounts of fuel result in incomplete combustion and the production of soot and other particulates. A further problem is the construction of the combustor and its operation to prevent rapid deterioration of the combustion chamber and the deposition of carbonaceous materials on the walls of the combustion chamber. Thus, proper cooling of the combustion chamber is necessary, as well as protection of the walls of the combustion chamber. Efficient evaporation and control of the water are also necessary to produce dry, clean steam. Unless the combustor is properly controlled, in addition to introducing the water into the flue gas properly, the water will prematurely dilute the combustion mixture, resulting in incomplete combustion and creation of the water-gas reaction, as opposed to combustion, and prematurely cool the combustion mixture, again producing excessive soot and particulates. All of these last mentioned problems are greatly compounded by size limitations on the generator. Usually, wells will be drilled and set with casing having an internal diameter of 13" or less and, less than 7" in most cases. Thus, the downhole generator should have a maximum diameter to fit in 13" casing and most preferably to fit into a 7" casing. Obviously, the tool should be durable and capable of many start-ups, thousands of operating hours and many shutdowns. Again, because of the nature of the operation, the tool should be designed to be flexible in construction, to permit ready inspection, repair and adjustment.

A very serious problem in the use of high pressure generators is the maintenance of design pressure in the generator, particularly in down hole operations. Since the back pressure exerted on the generator by well fluids varies considerably, initially increasing as fluid is injected and then decreasing as fluid production progresses, the internal generator pressure varies from the design pressure. As the internal generator pressure decreases, the fuel and combustion supporting gas flow decrease and the combustor is operated at less than the design heat release and inefficient operation results.

SUMMARY OF THE INVENTION

Figure 1:
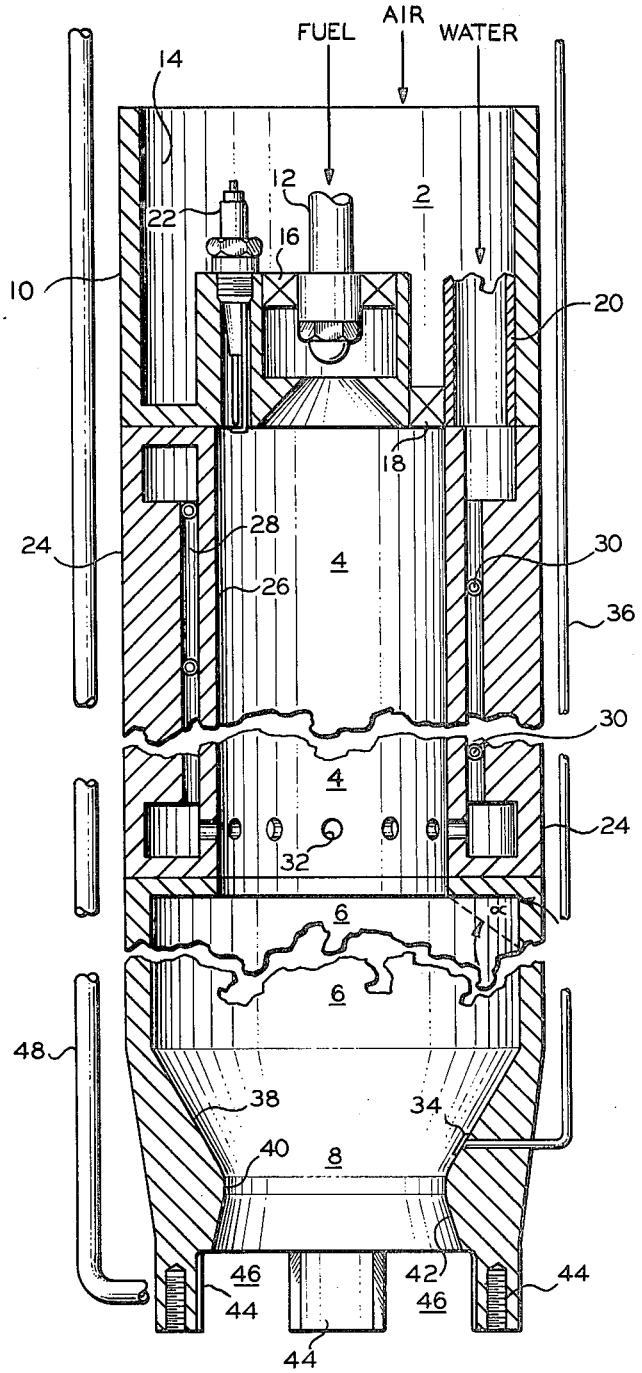
FIG. 1 is an elevational view, partially in section, of a steam generator in accordance with the present invention.

The present invention relates to a pressure control means for controlling the pressure within a tubular chamber containing a flowing fluid and adapted to discharge the flowing fluid from the downstream end thereof, including a diverging seat formed in the opening of the downstream end of the tubular chamber, a cone shaped plug slideably mounted adjacent the opening and having a contour adapted to prevent cavitation of the fluids being discharged from the tubular chamber and to form an annular opening between the plug and the diverging seat, a piston chamber mounted adjacent and spaced from the plug, a piston mounted in the piston chamber, shorter than the length of the piston chamber and essentially equal in cross section to the cross section of the chamber, slideably mounted in the chamber and in fluid-tight relation with the inner wall of the chamber to thus vary the void space within the chamber adjacent the ends of the piston and, including, a plurality of disc-type segments detachably coupled together to form the piston and having a reduced diameter shoulder formed on one end of each of the disc-type segments to form an annular channel between adjacent ones of the disc-type segments when the segments are coupled together and a sealing ring in the annular channel to produce the fluid-tight relation between the piston and the inner wall of the piston chamber, the plug being coupled to the piston to slide with the piston and an operating fluid introduction means adapted to introduce a pressurized operating fluid into the void space adjacent at least one end of the piston. The pressure control means is also mounted in the lower end of a steam generator comprising an elongated combustion chamber adapted to burn a fuel in the presence of a combustion supporting gas and produce a flue gas at the downstream end of the combustion chamber, water introduction means adapted to introduce water into the flue gas adjacent the downstream end of the combustion chamber, a vaporization chamber in open communication with the downstream end of the combustion chamber and adapted to vaporize a major portion of the water and produce a mixture of flue gas and steam at the downstream end of the vaporization chamber and the previously described pressure control means mounted in the downstream end of the vaporization chamber to control the pressure within the steam generator.

It is therefore and object of the present invention, to overcome the above-mentioned and other disadvantages of the prior art. Another object of the present invention is to provide an improved method and apparatus for the generation of steam for hydrocarbon recovery which reduces heat losses. A further object of the present invention is to provide an improved method and apparatus for generating steam for hydrocarbon recovery which can be utilized in deep reservoirs. Another and further object of the present invention is to provide an improved method and apparatus for generating steam for hydrocarbon recovery capable of pressurizing and/or repressurizing petroleum reservoirs. Yet another object of the present invention is to provide an improved method and apparatus for generating steam for hydrocarbon recovery which can conveniently be utilized in offshore operations. A further object of the present invention is to provide an improved method and apparatus for the generation of steam for hydrocarbon recovery which is capable of utilizing impure water, such as sea water. A still further object of the present invention is to provide an improved method and apparatus for generating steam for hydrocarbon recovery which greatly reduces or delays environmental pollution. Yet another object of the present invention is to provide an improved method and apparatus for generating steam for hydrocarbon recovery which is safe to use, both in a well bore and at the surface of the earth. Another object of the present invention is to provide an improved method and apparatus for generating steam for hydrocarbon recovery including a combustor having a high power output. A further object of the present invention is to provide an improved method and apparatus for the production of steam for hydrocarbon recovery capable of operating at a high pressure. Another and further object of the present invention is to provide an improved method and apparatus for the production of steam for hydrocarbon recovery, including a combustor having a high combustion stability and combustion efficiency. A still further object of the present invention is to provide an improved method and apparatus for the generation of steam for the recovery of hydrocarbons including a combustor which can be readily controlled with respect to the introduction of a fuel and combustion supporting gas and the control of the stoichiometry thereof, whereby a flue gas with minimal quantities of soot and other particulates is produced. Yet another object of the present invention is to provide an improved method and apparatus for the generation of steam for hydrocarbon recovery including a combustor capable of operating for extended periods of time and with minimal damage to and deposits on the combustor walls. Another and further object of the present invention is to provide an improved method and apparatus for the generation of steam for hydrocarbon recovery capable of producing clean, dry steam. A further object of the present invention is to provide an improved method and apparatus for the generation of steam for hydrocarbon recovery capable of efficient and complete production of steam. Yet another object of the present invention is to provide an improved method and apparatus for the generation of steam for hydrocarbon recovery wherein water for the production of steam is introduced in a manner which prevents the interference of the water with combustion and effectively mixes the water with combustion products. A still further object of the present invention is to provide an improved method and apparatus for the generation of steam for hydrocarbon recovery capable of attaining a uniform temperature distribution across the outlet thereof. A further object of the present invention is to provide an improved method and apparatus for the generation of steam for hydrocarbon recovery wherein the combustor is effectively cooled. Another object of the present invention is to provide an improved method and apparatus for the generation of steam for hydrocarbon recovery which is capable of use in the small diameter well bores. Still another object of the present invention is to provide an improved method and apparatus for the generation of steam for hydrocarbon recovery whose components are flexibly combined to permit ready inspection, repair and modification. A still further object of the present invention is to provide an improved method and apparatus for the generation of steam for hydrocarbon recovery which is capable of and/or convertible to the use of a wide variety of different fuels. A still further object of the present invention is to provide an improved method and apparatus for the generation of steam wherein the pressure within the generator is maintained at a predetermined value. Yet another object of the present invention is to provide an improved pressure control means for controlling the pressure within a tubular chamber. Another object of the present invention is to provide an improved pressure control means for controlling the pressure within a tubular chamber containing a flowing fluid at high pressure. These and other objects of the present invention will be apparent from the following description.

DESCRIPTION OF THE PREFERRED EMBODIMENTS

The flame in an elongated combustion chamber is stabilized while simultaneously reducing the deposition of the deposits on the inner walls of the combustion chamber by creating a first torroidal vortex of fuel and a first volume of combustion supporting gas, having its center adjacent the axis of the combustion chamber and rotaing in one of a clockwise or counterclockwise direction, and moving from the inlet end of the combustion chamber toward the outlet end of the combustion chamber; creating a second torroidal vortex of a second volume of combustion supporting gas, between the first torroidal vortex and the inner wall of the combustion chamber and rotating in the other of the clockwise or counterclockwise direction to produce a confined annular body of the second volume of combustion supporting gas, moving from the inlet end of the combustion chamber to the outlet end of the combustion chamber; and burning the fuel in the presence of the first and second volumes of combustion supporting gas to produce a flame moving from the inlet end of the combustion chamber to the outlet end of the combustion chamber and a flue gas substantially free of unburned fuel at the downstream end of the combustion chamber. The fuel may include any normally gaseous fuel, such as natural gas, propane, etc., any normally liquid fuel, such a No. 2 fuel oil, a No. 6 fuel oil, diesel fuels, crude oil, other hydrocarbon fractions, shale oils, etc. or any normally solid, essentially ashless fuels, such as solvent refined coal oil, asphaltene bottoms, etc. The combustion supporting gas is preferably air. In order to produce a flue gas substantially free of unburned fuel, an excess of air is utilized, preferably about 3% excess oxygen on a dry basis, above the stoichiometric amount necessary for complete combustion of all of the fuel. The relative volumes of the second volume of air and the first volume of air are between about 0 and 75% and between about 25% and 100%, respectively. Where the fuel employed is a normally gaseous fuel, the second volume of air is not necessary and, therefore, the minimum amount of the second volume of air is 0. However, where normally liquid or a normally solid fuels, whch form deposits on combustors, is employed, the minimum amount of the second volume of air should be a small amount sufficient to form the annular body of the second volume of air between the first torroidal vortex and the inner wall of the combustion chamber. Preferably, the volume of the second volume of air is between about 50% and 75% and the volume of the first volume of air is between about 25% and 50% of the total volume of the first and second volumes of air. Where the fuel is a normally liquid fuel, the fuel is preferably introduced by means of a spray nozzle adapted to produce droplet sizes below about 70 microns and the fuel should have a viscosity below about 40 cSt, preferably below about 20 cSt, still more preferably below about 7 cSt and ideally below about 3 cSt. Such droplet size can be produced by utilizing an air assisted nozzle, which also preferably sprays the fuel into the combustion chamber at a diverging angle, having an apex angle preferably of about 90°. The fuel may also be preheated to a temperature between ambient temperature and about 450° F. and preferably between ambient temperature and about 250° F. The limit of about 250° F. is generally dictated for fuels which are normally subject to cracking and thus producing excessive amounts of deposits. The viscosity of the heavier fuels may also be reduced by blending lighter fuels therewith, for example, by blending fuel oils with heavy crude oils. The air is also preferably preheated between ambient temperature and adiabatic temperature, preferably between ambient temperature and about 800° F. and still more preferably between about 200° F. and about 500° F. The flow velocity in the combustor is maintained above laminar flow flame speed. Generally, laminar flow flame speed, for liquid hydrocarbon fuels, is between about 1.2 and 1.3 ft/sec. and, for natural gas, is about 1.2 ft./sec. Consequently, the reference velocity (cold flow) maintained in the combustion chamber should be between about 1 and 200 ft. per second, preferably between about 10 and 200 ft. per second and still more preferably, between about 50 and 100 ft. per second, depending upon desired heat output of the combustor. The flow velocity, at flame temperature, should be between about 5 and 1,000 ft. per second, preferably between 50 and 1,000 ft. per second and still more preferably, between about 100 and 500 ft. per second. The method of burning fuel, is particularly useful for the generation of steam to produce a mixture of flue gas and steam for injection into heavy oil reservoirs. For this purpose, the power output should be at least about 7MM Btu/hr. for effective and economical stimulation of a well in most heavy oil fields. Consequently, the heat release of the combustion process should be at least about 50MM Btu/hr. ft.$^3$. Such a heat release rate is about 3 orders of magnitude greater than the heat release of typical oil-fired boilers currently in use in heavy oil recovery. The pressure of the mixture of flue gas and steam must be above about 300 psi for the fluids to penetrate the formation in most heavy oil fields. The steam generated may be between wet and superheat and preferably a vaporization of about 50% to superheat and still more preferably between 80% vaporization and superheat. For shale oil recovery, superheat of about 600° F. (an outlet temperature of about 1000° F.) is believed necessary.

The method of combustion and steam generation in accordance with the present invention is further illustrated by the following description of the apparatus in accordance with the present invention.

FIG. 1 of the drawings is a schematic drawing, in cross section, of a basic downhole steam generator. One of the distinct advantages of the basic steam generator is that it is capable of utilizing any readily available type of fuel, from gaseous fuels to solid fuels, with minor modifications. In general, such modifications involve only replacement of the combustor head, and/or, in some cases, the combustion chamber. Accordingly, it is highly advantageous to attach the head to the main body of the device so that it may be removed and replaced by a head adapted for use of different types of fuels. It should also be recognized that the device is capable of use at the surface of the earth, as well as downhole, to meet the needs or demands or desires for a particular operation. In either event, the distinct advantage of injecting the combustion gases or flue gas along with steam would be retained. More specifically, the unit can be mounted in the wellhead with the combustor head and fluid inlet controls exposed for easier control or the entire unit could be connected to the wellhead by appropriate supply lines so that the entire unit would be available for observation and control. For example, sight glasses could be provided along the body at appropriate points in order to observe the flame, etc. It would also be possible in such case to monitor the character of the mixture of flue gas and steam being injected and therefore, make appropriate adjustments for control of the feed fluids. When utilized outside the well, it is desirable from a safety standpoint, to mount the unit in a second of pipe or casing. However, it should be recognized that when the unit is located at the surface or in the top of the well, the advantage of reducing heat losses, which occur during transmission of the fluids down the well, does not exist and preferably the line through which the fluids are passing from the surface to the producing formation should be appropriately insulated.

The generator comprises four basic sections or modules, namely, a combustor head 2, a combustion chamber 4, a water vaporization chamber 6 and an exhaust nozzle 8. All of the modules are connected in a manner such that they are readily separable for the substitution of alternate subunits, servicing, repair, etc. In some cases, however, the combustion chamber 4 and water vaporization chamber 6 can be permanently connected subunits, since the unit can be designed so that these two subunits can be utilized for most types of fuel and most water injection and vaporization rates. In certain instances it may also be desirable to substitute a different exhaust nozzle or a different fuel introduction means and such subunits may be detachably coupled to the unit.

Air and fuel are brought to the combustor head 2 in rear stoichoimetric quantities, generally with 3% excess oxygen on a dry basis. As previously indicated, the fuel can be gases, such as hydrogen, methane, propane, etc., liquid fuels, such as gasoline, kerosene, diesel fuel, heavy fuel oils, crude oil or other liquid hydrocarbon fractions, as well as normally solid fuels, such as solvent refined coal (SCR I), asphaltenes, such as asphaltene bottoms from oil extraction processes, water-fuel emulsions, for "explosive atomization", water-fuel solutions for "disruptive vaporization" of fuel droplets, etc. The head 2 has a body portion or outer casing 10. A fuel introduction means 12 is mounted along the axis of casing 10 to introduce fuel centrally and axially into the combustion chamber 4. In the particular instance schematically shown herein, the fuel introduction means 12 is an atomizing nozzle adapted for the introduction of a liquid fuel. Such atomizing nozzles are well known in the art and the details thereof need not be described herein. However, the nozzle may be any variety of spray nozzles or fluid assist such as an air assist or steam assist nozzle. Obviously, an air assist nozzle, where such assistance is necessary, is preferred if there is no readily available source of steam and to prevent dilution in the combustion chamber. This is particularly true where the unit is utilized downhole and surface steam is not readily available. It would then be necessary to recycle a part of the effluent steam to the steam assist nozzle, a more difficult and unnecessary task. In any event, the nozzle 12 sprays the appropriately atomized liquid fuel in a diverging pattern into the combustion chamber 4. Combustion supporting gas, particularly air, is introduced into a plenum chamber 14 formed within outer casing 10. Obviously, the plenum chamber 14 can be separated into two or more separate plenum chambers for introducing separate volumes of air, as hereinafter described. It is also possible to supply more than one volume of air through separate lines from the surface. This, of course, would provide separate control over each of a plurality of volumes of air beyond that controlled by the cross-sectional area of the air openings in each specific case. It is also possible that each of the air entries to the combustion chamber could be constructed to vary the cross-sectional area of air openings and could be remotely controlled in accordance with techniques known to those skilled in the art. In any event, a first volume of air is introduced around nozzle 12 through a swirler 16. Swirler 16 may be any appropriate air introduction swirler which will introduce the air in a swirling or rotating manner, axially into the combustion chamber 4 and in a downstream direction. The specific variations would include a plurality of fins at an appropriate angle, such as 45°, or a plurality of tangentially disposed inlet channels. In any event, the air and fuel then enter combustion chamber 4 as a swirling or rotating core, rotating in a clockwise or counterclockwise direction. A second air swirler 18 is formed adjacent the inner wall of combustion chamber 4 and is of essentially the same construction as swirler 16. Swirler 18, in like manner to 16, introduces the air as a swirling or rotating body of air along the inner wall of combustor chamber 4. The rotation of the air by swirler 16 and swirler 18 are in opposite directions. Specifically, if the air is rotated in a clockwise direction by swirler 16, it should be rotated in a counterclockwise direction by swirler 18. This manner of introducing the air through swirlers is extremely important in the operation of the unit particularly where fuels having a tendency to deposit carbon and tar on hot surfaces are utilized and to prevent burning of the combustion chamber walls. Also introduced through combustor head 2 is water, through water inlet 20. Also mounted in the combustor head is a suitable lighter or ignition means 22. In the present embodiment, igniter means 22 is a spark plug. However, where fuels having high ignition temperatures are utilized, the igniter means may be a fuel assisted ignition means, such as a propane torch or the like which will operate until ignition of the fuel/air mixture occurs. In some cases, a significant amount of preheating of the fuel or fuel-air mixture is necessary.

The combustion chamber includes an outer casing 24 and an inner burner wall 26, which form an annular water passage 28 therebetween. Water passage 28 is supplied with water through water conduit 20 and cools the combustion chamber. This external cooling with water becomes a significant factor in a unit for downhole operation, since, in some cases, for example where the tool is to be run in a casing with an internal diameter of about 7 inches, the tool itself will have a diameter of 6 inches. This small diameter does not permit mechanical insulation of the combustion chamber and, accordingly, effective cooling is provided by the water. It should be recognized at this point that transfer of heat from the combustion chamber to the water in passage 28 is not necessary in order to vaporize the water since complete vaporization occurs downstream, as will be pointed out hereinafter. In order to prevent the formation of air bubbles or pockets in the body of cooling water, particularly the upper or upstream end of the channel, water swirling means 30 is spirally found in the water channel 28 to direct the water in a spiral axial direction through the channel. The water swirling means 30 can be a simple piece of tubing or any other appropriate means. A primary concern in the operation of the generator is combustion cleanliness, that is the prevention of deposits on the wall of the combustion chamber and production of soot emmissions as a result of incomplete combustion. This becomes a particular problem where heavy fuels are utilized and the problem is aggravated as combustor pressure increases and/or combustion temperature decreases. In any event, the manner of introducing the air into the generator substantially overcomes this problem. The counter rotating streams of air in the combustion chamber provide for flame stabilization in the vortex-flow pattern of the inner swirl with intense fuel-air mixing at the shear interface between the inner and outer streams of air for maximum fuel vaporization. Also, this pattern of air flow causes fuel-lean combustion along the combustion chamber walls to prevent build up of carbonacious deposits, soot, etc. Following passage of the water through channel 28, the water is injected into the combustion products or flue gases from combustion chamber 4 through appropriate holes or apertures 32. Another extremely important factor, in the operation of the steam generator is the prevention of feedback of excessive amounts of water from the vaporization section 6 into the combustion section 4, because of the chilling effect which such feedback would have on the burning of the soot particles which are produced during high pressure combustion. Such feedback is prevented by the axial displacement of the vortex flow patterns from the counter rotational air flow. Another extremely important factor in the operation of the steam generator is the manner of introduction of water into the flue gas. Such introduction is accomplished by introducing the water as radial jets into the flue gases, such jets preferably penetrating as close as possible to the center of the body of combustion products. The combustion products—water mixture is then abruptly expanded as it enters vaporization chamber 6. Accordingly, substantially complete vaporization will occur and the formation of water droplets or water slugging in the mixture will be eliminated. Abrupt expansion in the present case is meant to include expansion at an angle (alpha) significantly greater than 15°, since expansion at about 15° causes streamline flow or flow along the walls rather than reverse mixing at the expander. By the time the mixture of combustion products and water reach the downstream end of water vaporization chamber 6, substantially complete vaporization is attained. As will be discussed in greater detail hereinafter, exhaust nozzle 8, designed to discharge the combustion product-steam into the formation being treated, controls the pressure of discharge of the mixture and the pressure within the generator. As has been pointed out previously, the injection of both the steam and the combustion products into the formation has a number of very significant advantages, including elimination of air pollution and enhancement of oil recovery.

As previously indicatd, the nozzle 8 attached to the downstream end of the vaporization chamber is a major factor in the control of the generator. In order to effect such control, as shown in FIG. 1, a pressure sensor 34 is disposed in the downstream end of the vaporization chamber and is connected to a line 36 which transmits the sensed of pressure to the surface of the earth or other control location. In the embodiment illustrated, the nozzle 8 is formed by reducing the diameter of the flowing fluids by converging the wall 38 to form a reduced diameter section or vena contracta 40 and thereafter diverging the wall 42. In order to prevent interference of the nozzle with the flow of fluids, the angle of divergence of wall 38, is preferably below about 30° and the angle of divergence of the wall 42 is preferably below about 15°. However, it should be recognized that other appropriate openings may be utilized in accordance with the present invention. When the fluids are discharged through nozzle 8 an extension 44 is provided at the downstream end of the nozzle for attachment of the hereinafter mentioned valve, discussed in detail in connection with the following drawings. THe extension 44 has formed therein a plurality of openings 46 about the periphery for the discharge of fluids from the vaporizer. This manner of discharge will be more apparent from the discussion of FIG. 2. At least one operating fluid line 48 extends from a source of a pressurized operating fluid at the surface of the earth or other control location to a point adjacent the bottom of the vaporization chamber, as will be more readily apparent from the discussion of the following drawings.

Figure 2:
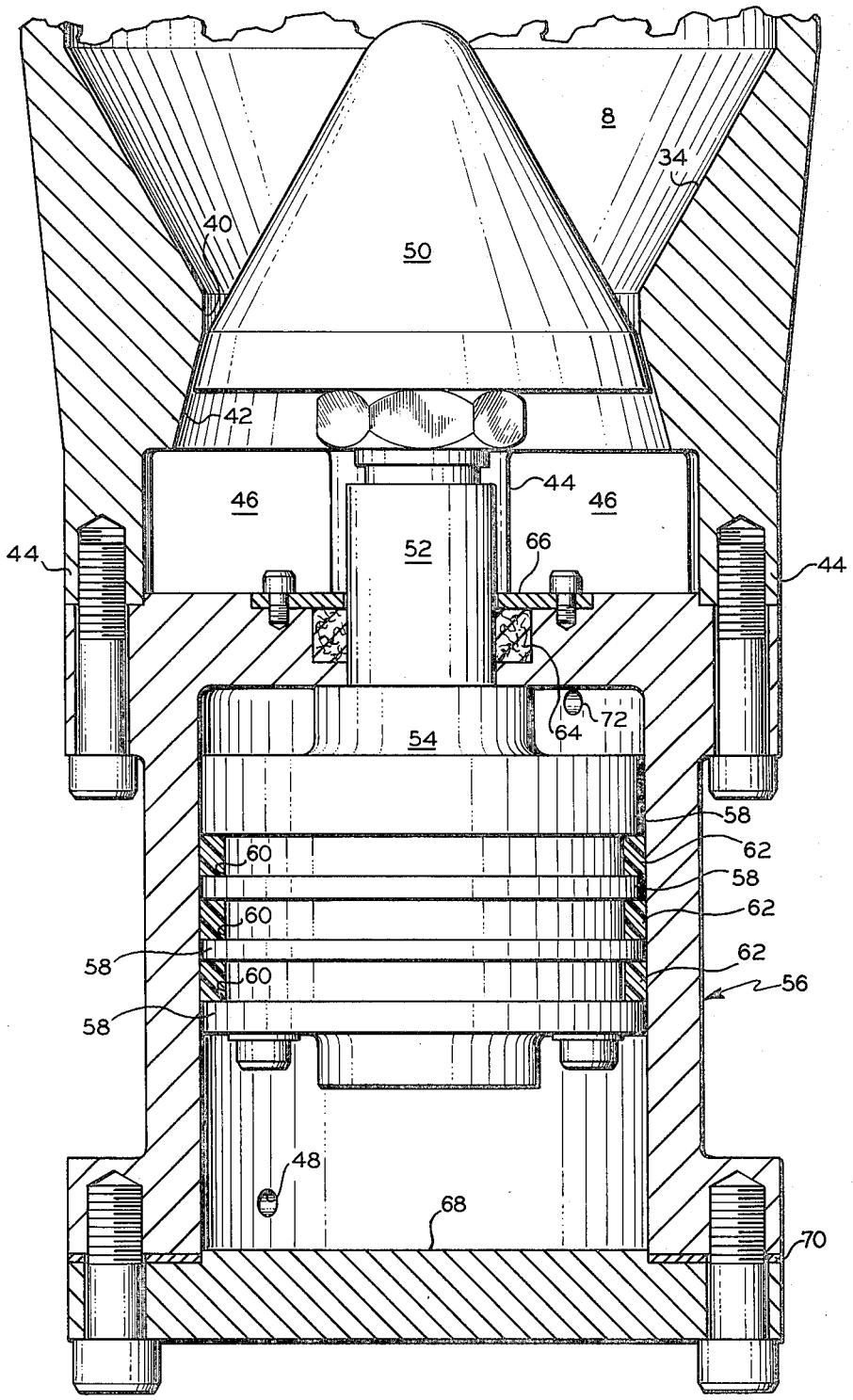
FIG. 2 is an elevational view partially, in cross section, of a pressure control means mounted in the lower end of the steam generator of FIG. 1.

FIG. 2 of the drawings shows a preferred pressure control means in accordance with the present invention. The pressure control means comprises a plug means 50, a connector or stem 52 and a piston 54 mounted in the piston chamber 56. The control means in the present case must operate in a very hostile environment, to the extent that the pressure within the generator is preferably high. The flow velocity of the fluids from the generator is high, the temperatures within and outside the generator are high and the fluids exiting the generator are often quite corrosive. Accordingly, plug 50 is a cone shaped plug contoured to prevent flow separation and cavitation. Such cavitation obviously will pit and wear away the solid surfaces of the plug and such erosion will be aggravated by the pressures, the temperatures and the corrosive nature of the fluids. In order to prevent such cavitation, it has been determined that the slope of the cone should be less than about 30° with respect to a vertical line from the periphery of the base. The piston 54 is also designed to withstand the severe conditions under which the device must operate. For this purpose, piston 54 is formed of a plurality of disc-type segments 58 detachably coupled together to form the overall piston. A reduced diameter shoulder 60 is formed on one end of the disc-shaped segments so that when the segments are assembled to form piston 54, a plurality of annular channels will be formed about the periphery of the piston to receive a plurality of sealing rings 62. Thus, the segmented construction of piston 54 not only facilitates assembly and insertion of the annular sealing ring 62, but permits servicing to replace the sealing rings. Piston chamber 56 is detachably coupled to extension 44 of nozzle 8 and, because of its spacing from the end of nozzle 8, forms peripherally disposed openings 46 through which the fluids from the generator are discharged to the outside of the generator. Stem 52 passes through a central aperture in the upstream end of piston chamber 56 and moves therethrough in fluid tight relationship as a result of the mounting of annular seal 64 between the stem and the opening. Seal 64 is held in place by means of detachably mounted ring 66, thus again aiding assembly and servicing of the unit. Similarly, the downstream end of piston chamber 56 is closed by a detachable closure plate 68 with sealing gasket 70 therebetween. Plug 50 is also detachably mounted on piston 54 to facilitate assembly and servicing. In the particular instance shown, the pressure controller is operated by the injection of an operating fluid under pressure through line 48 into the void space at the upstream end of the piston chamber. The void space in the downstream end of piston chamber 56 is provided with at least one pressure relief hole 72. Thus, a single acting piston is shown. However, it is also obvious that a double acting piston can be utilized by injecting and withdrawing fluids from the void spaces at both the upstream end and the downstream end of the piston chamber.

Figure 3:
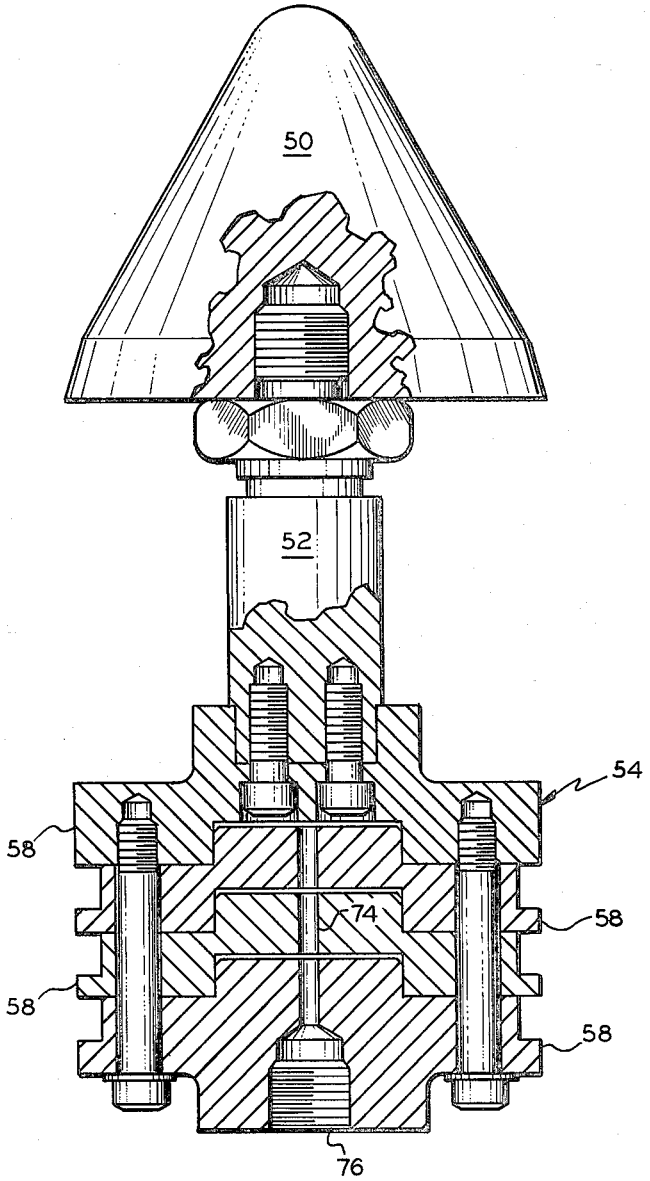
FIG. 3 is an elevational view, partially in section, of the plug and piston of the pressure control means of FIG. 2.

FIG. 3 of the drawings shows impartial cross section in greater detail of the construction and assembly of the plug, the stem and the piston. Corresponding parts utilize the same members as in FIG. 2. In addition, a channel 74 is formed through the disc-shaped segments of piston 54 to relieve the pressure between the sections during assembly and this channel is then closed by an end plug 76.

Figure 4:
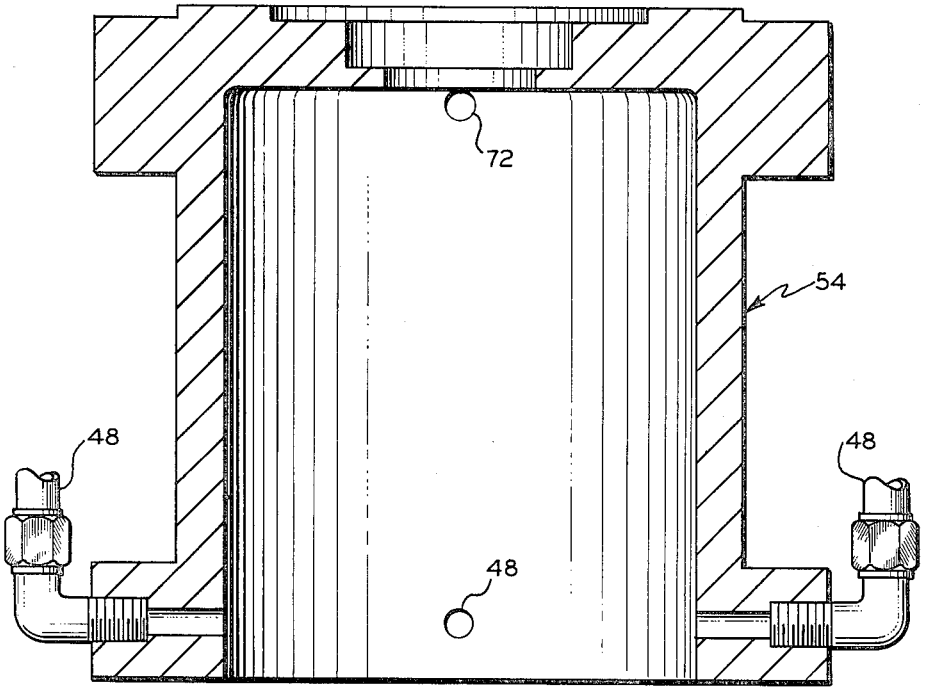
FIG. 4 is an elevational view of the piston chamber of the pressure control means of FIG. 2.

FIG. 4 of the drawings is a partial view of piston chamber 54 showing lines 48 for introducing operating fluid into the chamber.

In the operation of the device, the pressure sensed by pressure sensor 34 is transmitted to the surface of the earth or other appropriate location to a control instrument (not shown) which in turn controls the flow of operating fluid through supply line 48 in response to the sensed pressure. Such control instruments are well known in the art and therefore discussion thereof is unnecessary. Pressurized fluid is preferably air. Introduction of pressurized operating fluid into piston chamber 56 thus moves piston 54 toward and away from the nozzle at the lower end of the vaporization chamber, thus varying the annular space between plug 50 and diverging wall 42 of plug 8, thereby varying the volume of fluid discharged from the vaporization chamber and varying the pressure within the generator. Fluids flowing from the generator also act against plug 50. Accordingly, accurate and complete control of the pressure within the generator can be maintained.

While specific materials, items of equipment and assemblages of items of equipment have been referred to herein, it is to be understood that such references are by way of illustration only and are not to be considered limiting.

That which is claimed:

1. Steam generator means, comprising:

(a) elongated combustor means adapted to burn a fuel in the presence of a combustion supporting gas to produce a flue gas at the downstream end of said combustor;

(b) fuel introduction means adapted to introduce said fuel into the upstream end of said combustor;

(c) combustion supporting gas introduction means adapted to introduce said combustion supporting gas into said upstream end of said combustor;

(d) water introduction means adapted to introduce water into said flue gas adjacent the downstream end of said combustor to produce a mixture of flue gas and water adjacent said downstream end of said combustor;

(e) elongated vaporizer means in open communication with said downstream end of said combustor and adapted to vaporize a major portion of said water to produce a mixture of flue gas and steam at the downstream end of said vaporizer;

(f) pressure control means adapted to discharge said mixture of flue gas and steam from said downstream end of said vaporizer, adapted to vary the area of the discharge opening of said downstream end of said vaporizer to thus control the pressure within said combustor and said vaporizer and, including;

(1) plug means slideably mounted adjacent said discharge opening in said downstream end of said vaporizer and adapted to be moved toward and away from said discharge opening in said downstream end of said vaporizer to form an annular opening between said plug and said discharge opening in said downstream end of said vaporizer, (2) piston chamber means mounted adjacent and spaced from said plug and (3) piston means mounted in said piston chamber, shorter than the length of the interior of said piston chamber and essentially equal in cross section to the cross section of said interior of said piston chamber, slideably mounted in said piston chamber and in fluid-tight relationship with the inner wall of said piston chamber to thus vary the void space within said piston chamber adjacent the ends of said piston as said piston slides;

(g) said plug being coupled to said piston to slide with said piston; and (h) operating fluid introduction means adapted to introduce a pressurized operating fluid into said void space adjacent at least one end of said piston.

2. Steam generator means in accordance with claim 1 wherein the plug is a cone shaped plug having a contour adpated to prevent cavitation of the mixture of flud gas and steam being discharged from the downstream end of the vaporizer.

3. Steam generator means in accordance with claim 2 wherein the wall of the cone shaped plug has an angle of less than about 30° with respect to a line perpendicular to the base of said cone and extending from the periphery thereof.

4. Steam generator means in accordance with claim 1 which additionally includes extension means on the downstream end of the tubular chamber spanning the space between the piston chamber and the plug when in its extreme position toward the seat, and having a plurality of openings formed in the periphery of said extension and adapted to discharge flowing fluid from the annular space between said plug and said seat outwardly in a generally radial direction.

5. Steam generator means in accordance with claim 4 wherein the piston chamber is detachably coupled to the extension.

6. Steam generator means in accordance with claim 1 wherein the plug is coupled to the piston by stem means passing through an opening in the upstream end of the piston chamber and a sealing ring is mounted between said stem and said opening in the upstream end of said piston chamber.

7. Steam generator means in accordance with claim 6 wherein the sealing ring is held in the opening in the upstream end of the piston chamber by means of a detachably mounted retaining ring.

8. Steam generator means in accordance with claim 6 wherein the plug is detachably coupled to the stem and the stem is detachably coupled to the piston.

9. Steam generator means in accordance with claim 1, 2, 3, 4, 5, 6, 7 or 8 wherein the piston comprises at least two disc-type segments, at least one of which has a shoulder formed on one end thereof to form at least one annular channel when said segments are assembled to form said piston and sealing ring means mounted in said annular channel to thus maintain the fluid-tight relationship between said piston and the interior of said piston chamber.

10. Steam generator means in accordance with claim 1, 2, 3, 4, 5, 6, 7 or 8 wherein the piston comprises at least four disc-type segments at least three of which have a reduced diameter shoulder formed on one end thereof to form at least three annular grooves when said segments are assembled to form said piston and a sealing ring means is mounted in each of said annular channels to maintain the fluid-tight relationship between said piston and the inner wall of the piston chamber.

11. Steam generator means in accordance with claim 1, 2, 3, 4, 5, 6, 7 or 8 wherein the end of the piston chamber opposite the location of the plug is closed by a detachably coupled plate means.

12. Steam generation means in accordance with claim 1, 2, 3, 4, 5, 6, 7, or 8 which includes operating fluid introduction means adapted to introduce and remove operating fluid from both ends of the piston chamber and thus make the piston a double acting piston.

* * * * *